US010618794B2

(12) United States Patent
Raguzin

(10) Patent No.: US 10,618,794 B2
(45) Date of Patent: Apr. 14, 2020

(54) SYSTEM AND METHOD FOR PRESSURIZING A BEVERAGE CONTAINER

(71) Applicant: Eric Raguzin, East Northport, NY (US)

(72) Inventor: Eric Raguzin, East Northport, NY (US)

( * ) Notice: Subject to any disclaimer, the term of this patent is extended or adjusted under 35 U.S.C. 154(b) by 0 days.

(21) Appl. No.: 16/387,669

(22) Filed: Apr. 18, 2019

(65) Prior Publication Data

US 2019/0337788 A1 Nov. 7, 2019

Related U.S. Application Data

(63) Continuation of application No. 15/470,217, filed on Mar. 27, 2017, now Pat. No. 10,301,160.

(51) Int. Cl.

| | |
|---|---|
| ***B67D 1/00*** | (2006.01) |
| ***B67D 1/04*** | (2006.01) |
| ***B67D 1/12*** | (2006.01) |

(52) U.S. Cl.

CPC ..... *B67D 1/0075* (2013.01); *B67D 1/0406* (2013.01); *B67D 1/0412* (2013.01); *B67D 1/1252* (2013.01); *B67D 2001/0098* (2013.01)

(58) Field of Classification Search

CPC ... B67D 1/0075; B67D 1/0406; B67D 1/0412
USPC .... 222/61, 400.7, 400.8, 401, 402.1, 402.18
See application file for complete search history.

(56) References Cited

U.S. PATENT DOCUMENTS

| | | | |
|---|---|---|---|
| 4,711,377 | A | 12/1987 | Brown |
| 4,979,641 | A | 12/1990 | Turner |
| 5,431,302 | A | 7/1995 | Tulley et al. |
| 5,641,094 | A | 6/1997 | Wunsch |
| 5,785,211 | A | 7/1998 | Tieskoetter |
| 5,908,142 | A | 6/1999 | Sacchetti |
| 6,354,342 | B1 | 3/2002 | Gagliano |
| 6,651,852 | B2 | 11/2003 | Arellano |
| 6,783,034 | B1 | 8/2004 | Brent |
| 6,856,251 | B1 | 2/2005 | Tietsworth |
| 6,991,653 | B2 | 1/2006 | White et al. |
| 7,131,560 | B2 | 11/2006 | Hammond |
| 7,261,220 | B2 | 8/2007 | Campbell et al. |
| 7,523,695 | B2 | 4/2009 | Streeter et al. |
| 8,158,083 | B2 | 4/2012 | Krug et al. |
| 9,243,830 | B2 | 1/2016 | Chadwell et al. |
| 2007/0204930 | A1* | 9/2007 | Phallen ..... B67D 1/1234 141/83 |

(Continued)

FOREIGN PATENT DOCUMENTS

| | | | |
|---|---|---|---|
| CN | 201686168 | U | 12/2010 |
| EP | 1118582 | A2 | 7/2001 |

*Primary Examiner* — Vishal Pancholi
(74) *Attorney, Agent, or Firm* — Dilworth & Barrese, LLP

(57) ABSTRACT

A system and method is provided for electronically adjusting the pressure in a beverage container during regular use. The system includes a connector attachable to a tapping connector of the beverage container; a gas pump operably connected to the connector for supplying pressurized gas into the beverage container through the tapping connector; a pressure sensor operably connected to the beverage container for outputting a pressure signal corresponding to an internal pressure within the beverage container; a power supply; and a controller adapted to control the gas pump based on the internal pressure and a set point pressure to maintain the internal pressure at the set point pressure.

20 Claims, 10 Drawing Sheets

(56) References Cited

U.S. PATENT DOCUMENTS

| | | | | |
|---|---|---|---|---|
| 2008/0128456 | A1 | 6/2008 | Grimwade | |
| 2008/0251536 | A1 | 10/2008 | Wong | |
| 2010/0059548 | A1 | 3/2010 | Smid | |
| 2010/0243676 | A1 * | 9/2010 | Bax | B08B 9/0552 222/148 |
| 2011/0180565 | A1 | 7/2011 | Racino et al. | |
| 2012/0118328 | A1 | 5/2012 | West et al. | |
| 2015/0283570 | A1 | 10/2015 | West et al. | |
| 2016/0083239 | A1 | 3/2016 | Rasmussen et al. | |
| 2016/0137481 | A1 | 5/2016 | Chadwell et al. | |

* cited by examiner

SYSTEM AND METHOD FOR PRESSURIZING A BEVERAGE CONTAINER

TECHNICAL FIELD

The present application generally relates to systems and methods for pressurizing a beverage container. Specifically, the present application relates to systems and methods for electronically adjusting the pressure in a beverage container during regular use.

BACKGROUND

The present disclosure relates to improving the pressurization of a draught beverage (which may be alcoholic, for example lager) in a beverage container, such as a keg. However, other applications are contemplated, including medical applications and applications in a fluid system which dispenses beverages under controlled pressure.

Kegs hold fluid such as beer under pressure. One type of standard beer keg has a gas chamber and a separate beverage chamber, which may be separate physical spaces, configured as a gas space and a fluid space. A tap assembly includes a gas valve that allows the gas chamber to be pressurized with a gas, normally nitrogen for wine, and carbon dioxide ($CO_2$) for beer or soda, and has a pressure regulator that passes the gas at a uniform pressure to the beverage chamber where it forms a gas head. A riser tube is connected through the tap assembly to a tap valve and extends down to a lower region of the beverage chamber so that when the tap valve is open the gas head pushes the beverage up the riser tube and out a spout of the tap valve.

Known methods of providing pressure to a gas chamber include manual pumped pressurized air systems and systems pressurized using external containerized sources of compressed gas. Externally pressurized systems are common in commercial systems that require heavy bottles of compressed $CO_2$ gas that supply the compressed gas through regulators and pressure lines to pressurize one or more kegs.

Commercial retailers and other long-term dispensers of tap beer, such as taverns, clubs and bars, usually have an electrical pump for pressurizing beer kegs. Many also employ carbon dioxide under pressure in a tank for generating gas bubbles that form a thick head of foam on tops of beer in beer glasses and mugs. Some use either the electric pump or the pressure tank separately. A known drawback of the commercial systems is that they rely on electrically actuated pressure valves that do not allow the user to alter the pressure during regular use. A further drawback of the commercial systems is that they draw significant power, necessitating a connection to a power outlet.

Manually pumped pressurized air systems are common in consumer systems and typically rely on a manual air pump to pressurize the keg. Intermittent users and short-term users of beer kegs comprise a large portion of the market for tap beer. The kegs of beer is sold to the intermittent and short-term users through liquor stores and, where legal, through grocery stores and liquor departments of supermarkets. The same kegs or slightly larger ones with the same keg-faucet connectors are used for intermittent and short-term users and for commercial and long-term users. Instead of an electrical pump and/or a pressure tank, a hand pump on a hand-pump faucet of various types is used by the intermittent and short-term users. Many retailers of tap beer with relatively low sales volume also use the hand-pump faucet. A known drawback of the manually pumped pressurized air systems is that they are difficult to reliably maintain the pressure during regular use.

With particular reference to portable $CO_2$-based dispensers, the pressure maintained in the keg is only crudely controlled via a manually-adjusted, mechanical pressure regulator. In such an arrangement, a decrease in the temperature of the fluid in the keg will result in a drop in pressure and a concomitant injection of additional supplemental gas; a subsequent increase in temperature will result in an increase in pressure without a suitable release of gas.

Mechanical pressure relief valves are designed to prevent rupture of the keg and are generally insufficient to prevent over-pressurization of the beer, especially low-carbonation ales and the like.

A further drawback of such systems is the unpopularity of $CO_2$ high-pressure cartridges, especially for persons who buy party beer kegs only occasionally, as it is not worthwhile to procure an expensive tap fitting. Some people are even uncomfortable handling high-pressure $CO_2$ cartridges. Others worry about the replacement supply of cartridges. A further drawback of the high pressure cartridges is that they are stored at pressures up to approximately 850 psi, and thus the bottle for storing the liquid to be carbonated must be a fairly heavy, thick-walled apparatus. Such systems were and are commonly used to make seltzer water. However, such heavy pressure bottles are expensive and relatively awkward to handle.

Therefore, there is a need in the art for a system and method that allows a user to alter the pressure of a beverage container during regular use, without the need for a large and separate supply of pressurized gas does not require the use of significant power.

The present invention solves these and other problems in the prior art.

SUMMARY

An electronic pressurization system, apparatus and method is provided herein. The electronic pressurization system is adapted to dispense a beverage under pressure by allowing a user to electronically regulate the pressure within a beverage container during regular use without the use of a separate pressurized supply of gas. The invention incorporates hardware and software components for dispensing beverages under pressure via real-time electronic regulation under user control.

According to one embodiment, a system for pressurizing a beverage container having a tapping connector, includes a connector attachable to the tapping connector of the beverage container; a gas pump operably connected to the connector for supplying pressurized gas into the beverage container through the tapping connector; a pressure sensor operably connected to the beverage container for outputting a pressure signal corresponding to an internal pressure within the beverage container; a power supply; and a controller adapted to control the gas pump based on the internal pressure and a set point pressure to maintain the internal pressure at the set point pressure.

According to another embodiment, an apparatus for pressuring a beverage container, said apparatus includes a housing defining an interior volume; a controller disposed in said housing; a pressure sensor operably connected to the beverage container and configured to sense the internal pressure within the beverage container, said pressure sensor further configured to output to the controller a pressure signal representative of the sensed pressure; a connector attachable at a first end to a tapping connector of the beverage container and at a second end to the pressure sensor for sensing a pressure within the beverage container; a gas pump connected to the connector and configured to supply pressurized gas into the beverage container through the tapping connector to create pressure therein; a display configured to display the internal pressure within the beverage container based on the pressure signal output by the pressure sensor; a user interface supported by a surface of said housing to enable a user to change a set point pressure within the beverage container during regular use, wherein the controller disposed in said housing is configured to receive the pressure signal sensed and output by said pressure sensor; output the pressure signal received from the pressure sensor to the display unit; receive the set point pressure from the user interface; and output a signal to the gas pump to turn the gas pump on or off; and a power supply for supplying power to said pressure sensor, said controller, said display unit and said user interface.

According to another embodiment, a method for regulating the pressure within a beverage container during regular use, includes the steps of acquiring by a controller an internal pressure of a beverage container from a pressure sensor; displaying on a display unit, the internal pressure; maintaining the internal pressure at a set point pressure; and monitoring a user interface to determine if a user requests a change of the internal pressure.

According to another embodiment, a method of determining a volume of liquid in a beverage container, includes the steps of determining a start pressure of the beverage container by a sensor configured to sense the internal pressure of the beverage container; determining an end pressure after an elapsed period of time; comparing the end pressure to the start pressure; determining a volume of liquid in the beverage container based on the comparison.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION OF PREFERRED EMBODIMENT(S)

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

The present disclosure describes a novel electronic pressurization system, apparatus and method, particularly for use with beverage containers or the like, which overcomes one or more of the drawbacks of known devices. More specifically, according to some embodiments, the invention provides for a more efficient, less expensive and more reliable pressurization system and device.

Prior art kegs are used for the storage and transportation of beverages such as beer. A top surface of the keg includes an opening to which a dispensing tap may be attached so as to allow for dispensing of the beverage stored within the keg.

Turning now to the drawings, and in a preferred embodiment, a system for pressurizing a beverage container according to the present disclosure, will be described. The system 10 for pressurizing a beverage container (e.g., keg 30) is connected to the top of a tap 20. The bottom of tap 20 is configured to be coupled to keg 30 via known couplers.

Figure 1:
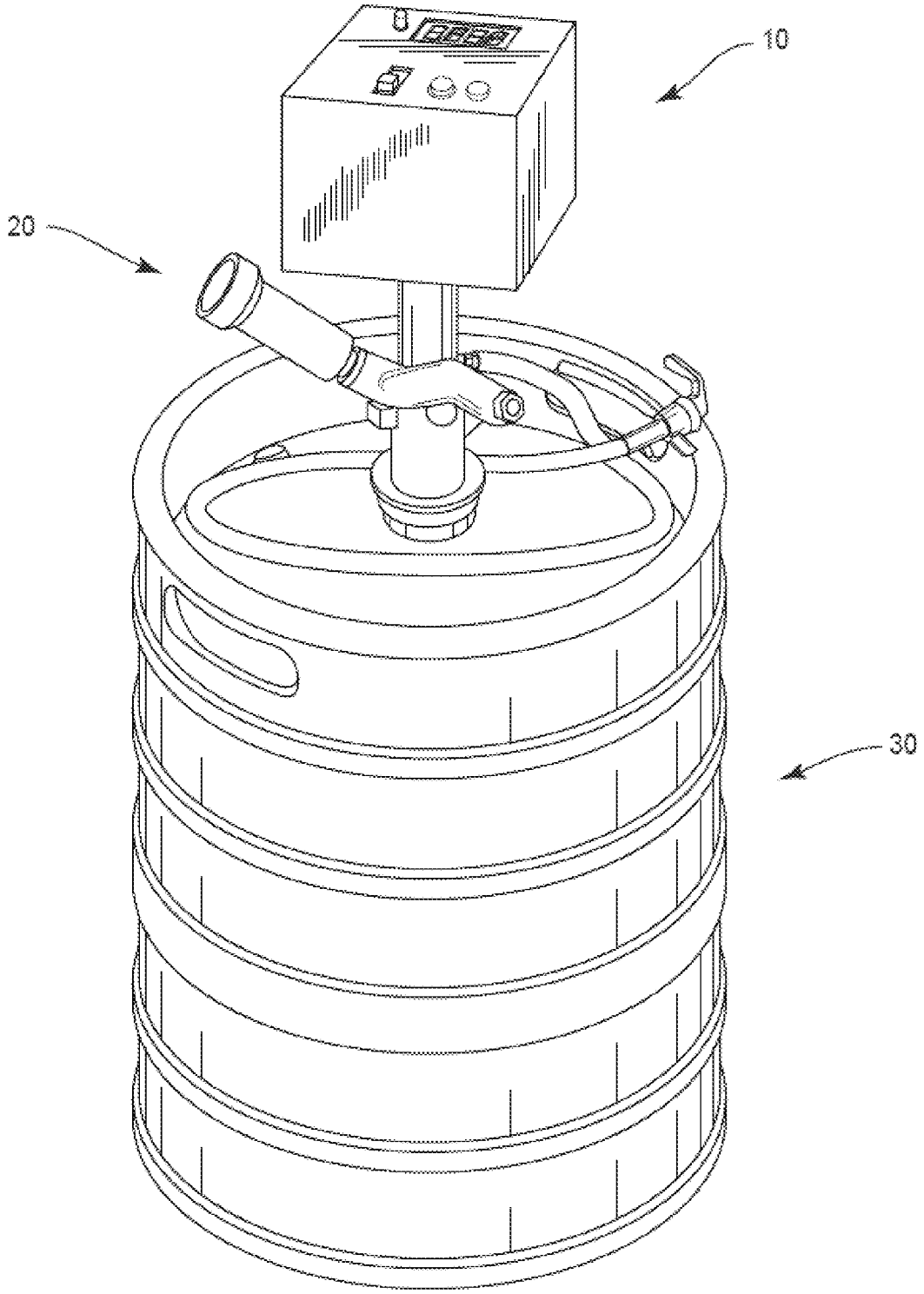
FIG. 1 is a perspective view of a system for pressurizing a beverage container according to the present disclosure.
Figure 2:
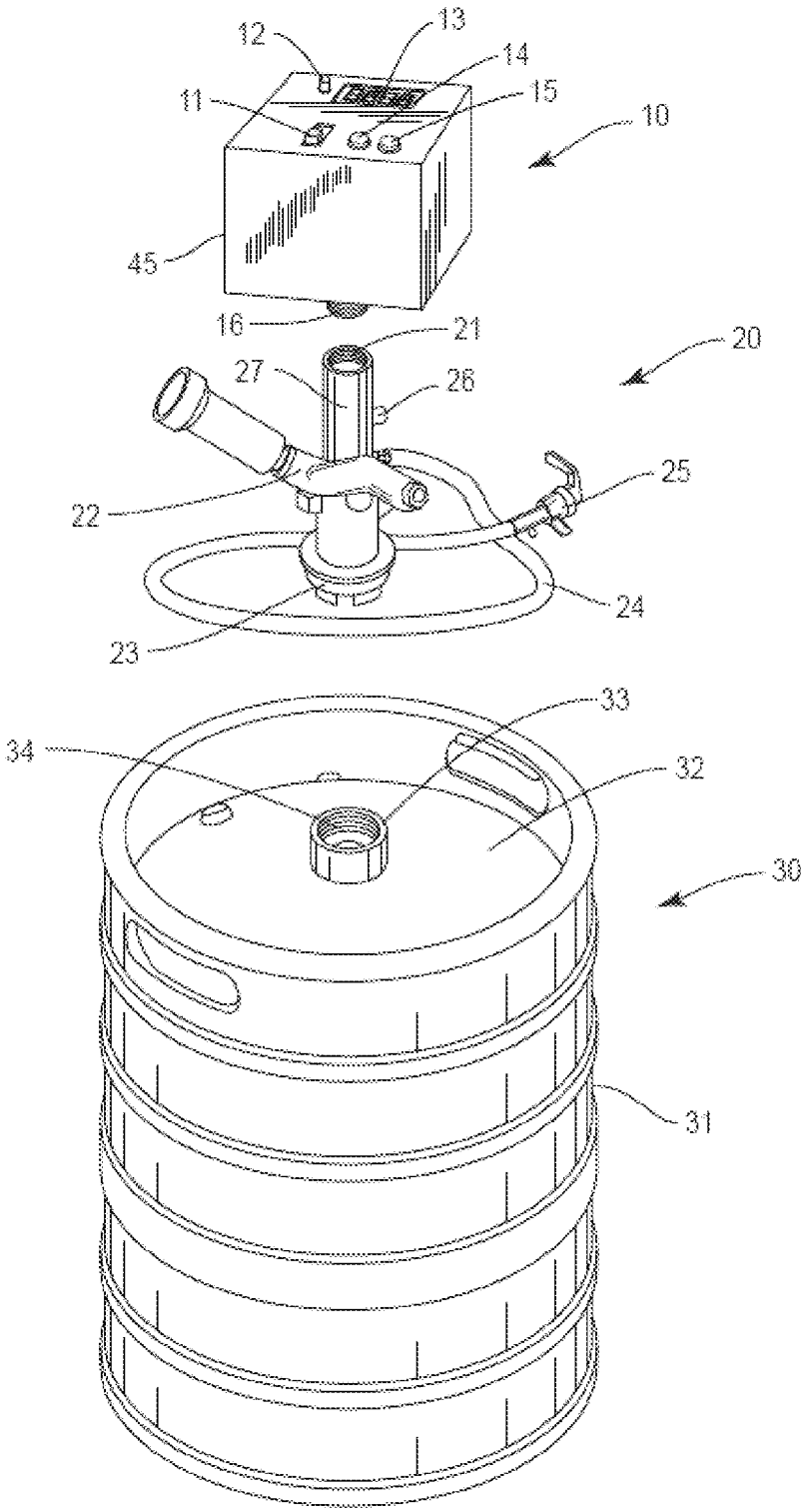
FIG. 2 is an expanded view of the system for pressurizing a beverage container according to the present disclosure.
Figure 3:
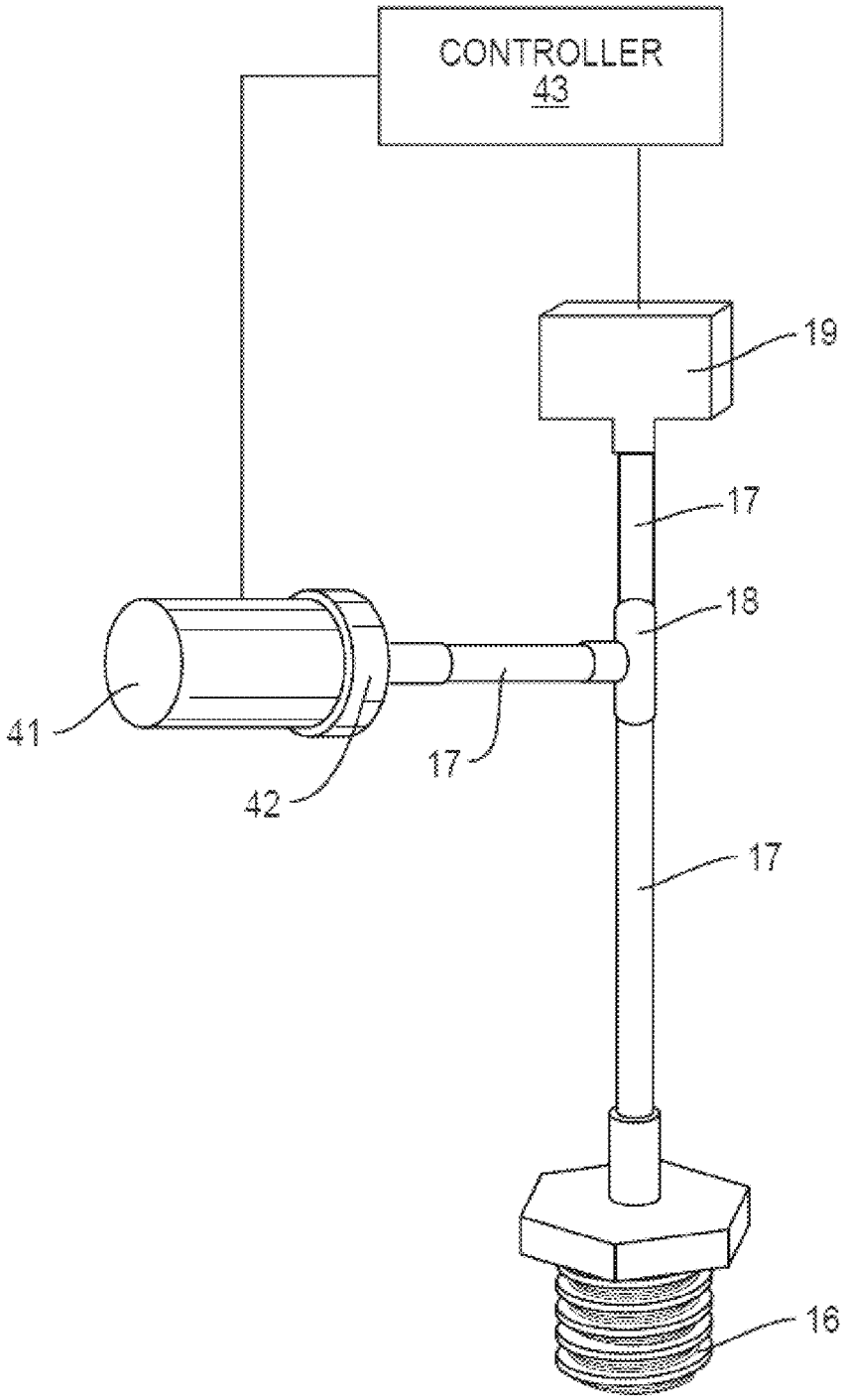
FIG. 3 is a perspective view of the system for pressurizing a beverage container according to the present disclosure.
Figure 4:
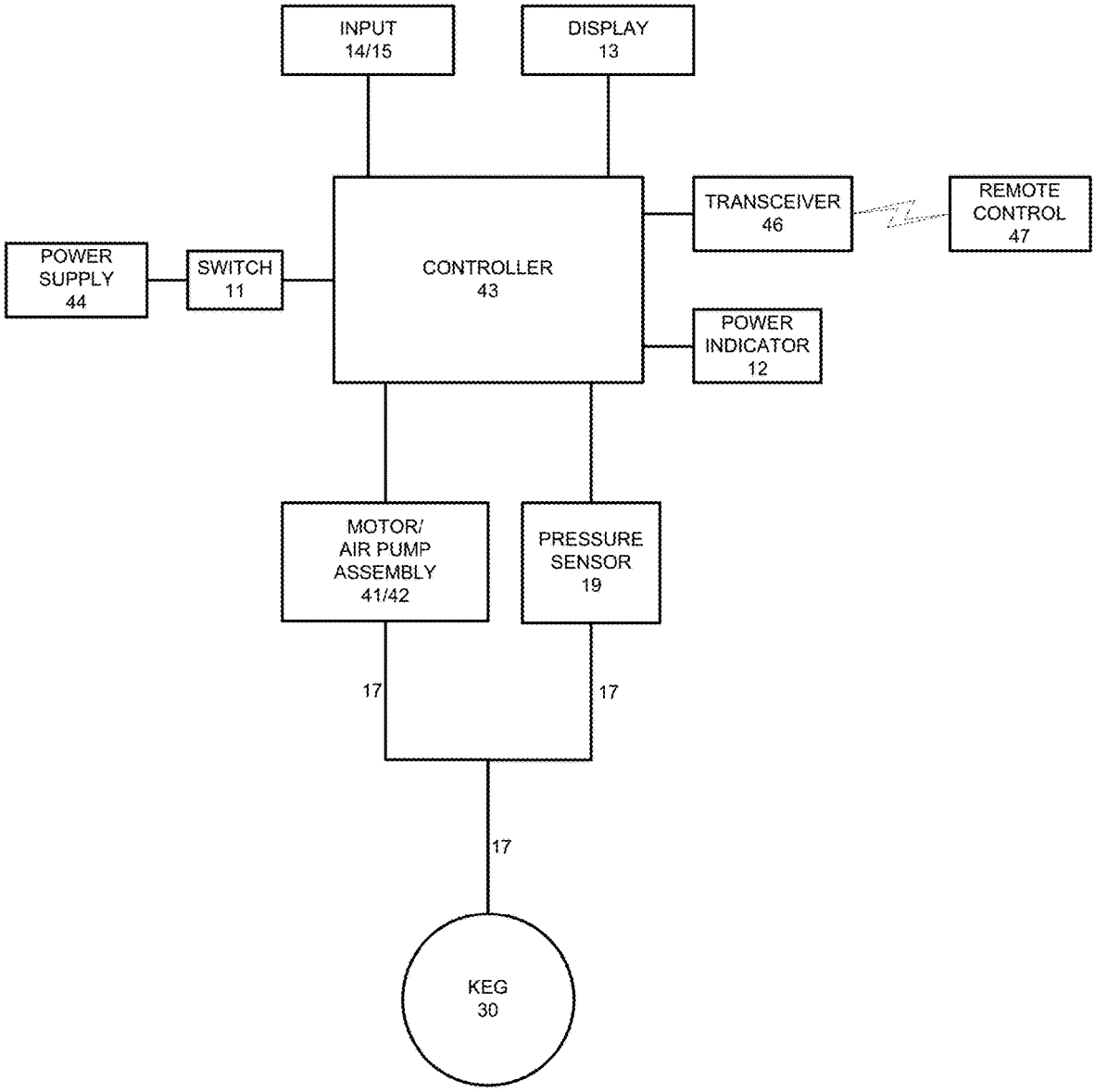
FIG. 4 is a block diagram of the system for pressurizing a beverage container according to the present disclosure.

System 10 includes an enclosure 45 that contains a power switch 11, an optional power indicator 12, a display 13, and input buttons 14/15. As shown in FIG. 2, a fitting 16 is shown extending from the bottom of enclosure 45. Display 13 can include, for example, an LCD display, an alphanumeric display, one or more LEDs, to indicate to a user various status conditions, etc. Display 13 provides information to a user, and various means for providing this information are contemplated.

Enclosure 45 contains fitting 16, motor/gas pump assembly 41/42, pressure sensor 19, a controller 43, and a power supply 44. Tubing 17 connects pump 42, pressure sensor 19, and fitting 16 through tee fitting 18. Fitting 16 is connected, directly or indirectly, to a motor/gas pump assembly 41/42 and a pressure sensor 19.

Controller 43 is operatively connected to motor/gas pump assembly 41/42 to control the operation thereof. Controller 43 is also operatively connected to pressure sensor 19 to periodically receive pressure signals generated in real time by pressure sensor 19. The pressure signals are indicative of the current pressure in keg 30.

Tap 20 serves as an interface between system 10 and keg 30. Tap 20 includes a central body 27 having an inlet 21 configured to connect to and mate with fitting 16 of system 10 to receive pressurized gas from pump 42 which can be electronically adjusted in real time by controller 43. Tap 20 also includes a keg connector 23 for connecting with keg 30 and a handle 22 for sealing the connection with keg 30. Keg connector 23 is configured to permit pressurization into keg 30. Keg connector 23 is also configured to permit liquid (not shown) to flow out of keg 30, into central body 27, for distribution to an end user through a hose 24, and out of dispensing valve 25. A pressure relief valve 26 is also connected to central body 27, to prevent over-pressuring of keg 30. Keg 30 is comprised of a body 31 having an upper end 32. Positioned on upper end 32 is fitting 33 that includes a tap connector 34 for coupling to keg connector 23 of tap 20.

Tap 20 and keg 30 are of prior known configurations and include known couplers, for example, a U.S. Sankey coupler or a German slider style coupler. Either tap 20 or keg 30 can include an inlet attached to system 10 for receiving the pressurized gas from system 10.

Controller 43 is adapted to control gas pump 42 via motor 41 to apply a user selected set-point pressure to keg 30. A suitable controller is an Atmel model ATMEGA328P-PU controller. Motor/gas pump assembly 41/42 is a low power unit that operates at a voltage that is less than a typical line voltage, for example, an AJK Technologies model AJK-B2701 gas pump. Pressure sensor 19 is configured to determine the pressure within keg 30. A suitable pressure sensor is a Freescale Semiconductor/NXP model MP3V5050GP pressure sensor.

Gas pump 42 operates at a low voltage, for example, 6-24 volts DC, and 400-100 mA. Gas pump 42 can deliver a maximum pressure of 450 mm HG. Gas pump 42 is designed to provide pressurized gas into keg 30. Such gases can include air, $CO_2$, nitrogen, etc.

In some embodiments, a pressure regulator 48 can be included to stabilize (i.e., filter) the reading from the pressure sensor 19 during operation. A suitable component to use as a pressure regulator is a Texas Instrument model TLV2462CP op amp.

Power supply 44 is preferably one or more batteries (e.g., a battery pack). In one embodiment, the battery pack may be 4 AA batteries. In other embodiments, the power supply 17 may be a car battery connected through a cigarette lighter socket, or by an AC/DC converter which can transform 110 volt AC or another AC voltage to a 12 volt DC output. Other power supply sources are contemplated.

Figure 5:
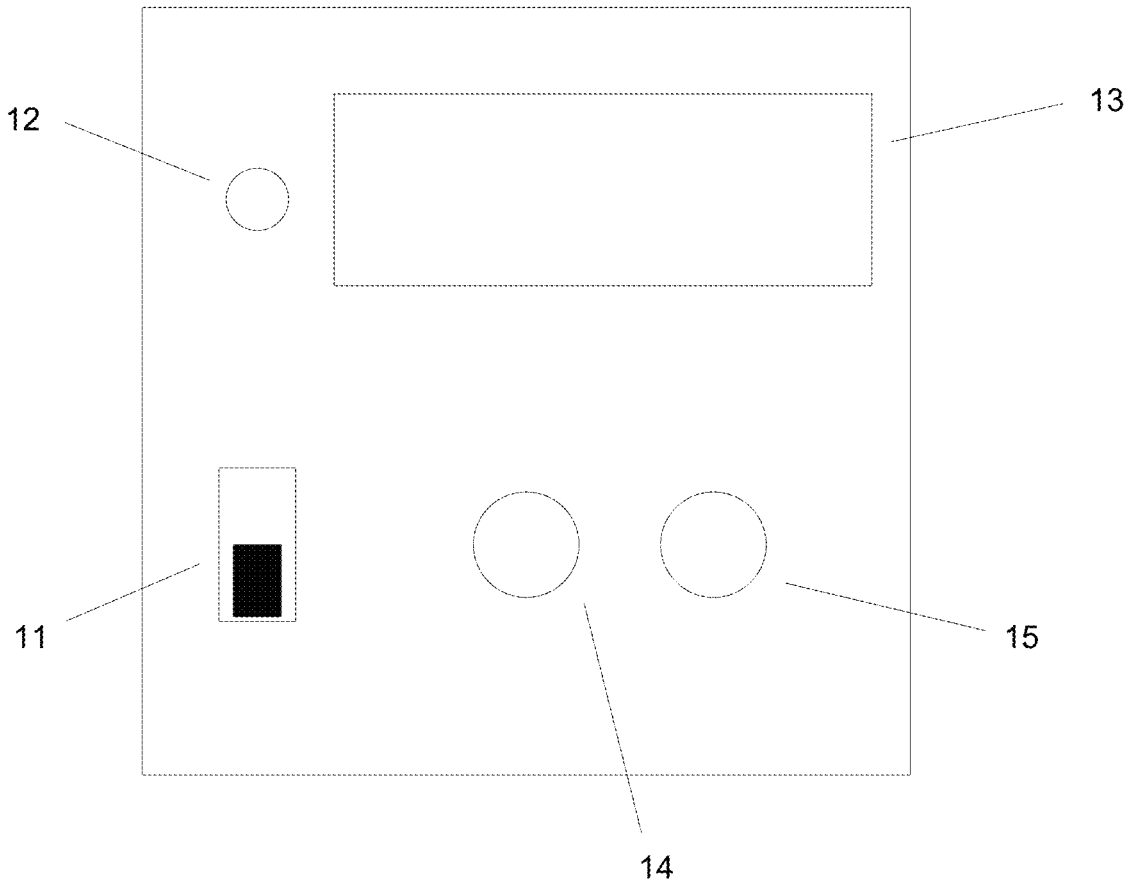
FIG. 5 is a diagram illustrating the user interface of the system for pressurizing a beverage container according to the present disclosure.

FIG. 5 is an illustration of a user interface of system 10 according to one embodiment. In conjunction with controller 43, the user interface allows for system 10 to accommodate varying characteristics associated with beverage dispensing and real time pressurization. The user interface typically includes one or more input buttons 14/15, which provide for user-selectable indicia such as increasing or decreasing the set-point pressure of keg 30. The user interface may also include a power indicator 12 to indicate when power is available to system 10. In addition, the user interface includes display 13 that provides the user with data concerning the operation of system 10, for example, display 13 can display the pressure within keg 30. In addition, display 13 can display a pressure being set by a user when a user is setting the desired pressure by operating input buttons 14/15.

Figure 11:
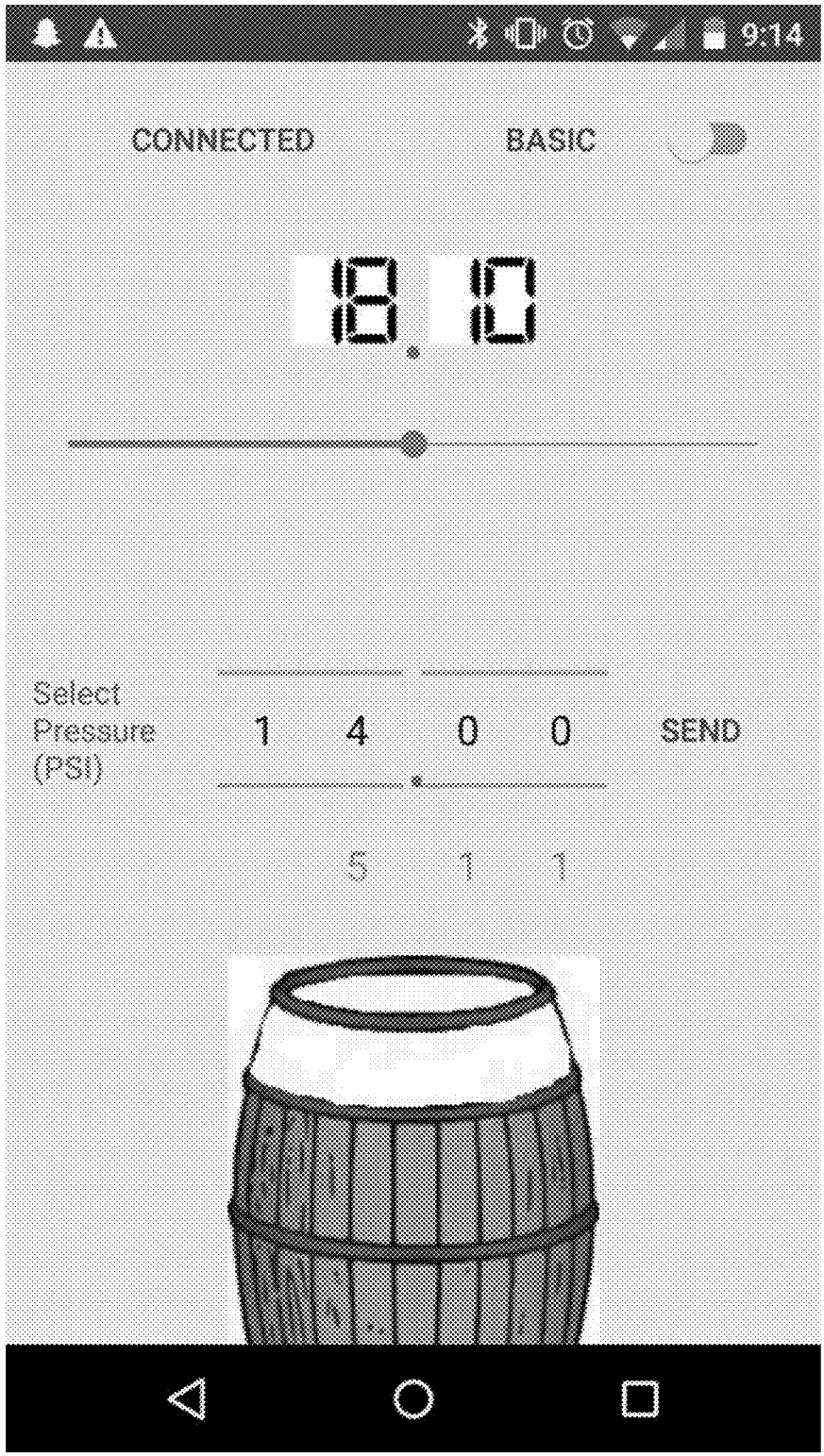
FIG. 11 is an example screen shot of a remote control for a system for pressurizing a beverage container according to the present disclosure.

As an alternative input device, pressure setting signals and other control signals can be received from a wireless external remote control 47 through a transceiver 46. One example of the wireless external remote control 47 is a smart phone running an app as shown in FIG. 11. The app can be designed to receive inputs from a user, send control signals to system 10, receive data from system 10, and display various conditions of keg 30 and system 10 on a display. The transceiver/remote control 46/47 can transmit/receive using LED technology, radio waves, Bluetooth, Wifi, or other known technologies. Utilizing the wireless channel, system 10 can also send data and other information to the wireless external remote control 47. This data can include battery status, keg volume status, current pressure, and other data representing conditions of the keg. For example, with the inclusion of a temperature sensor, system 10 can transmit temperature readings to wireless external remote control 47. This data can also be displayed on display 13.

Based on the reading of the pressure in pressure sensor 19 in relation to a user selected set point pressure, controller 43 can actuate the motor/gas pump assembly 41/42. Through control schemes such as PID and Pulse Width Modulation, flow rate for gas pump 42 can smoothly slow down as the user selected set point pressure is approached. Overall, this approach adds significant functionality to existing electrical keg pumps and works at much lower power, allowing the device to be powered entirely by a battery or other power source for the typical duration of use and be manufactured at a much lower cost.

In an alternative embodiment, an electronically activated relief valve (not shown) could be added into system 10 to provide for means to decrease the pressure should the pressure be too high. One such relief valve is the Electronic Pressure Relief Valve made by Kelly Pneumatics, Inc.

Figure 6:
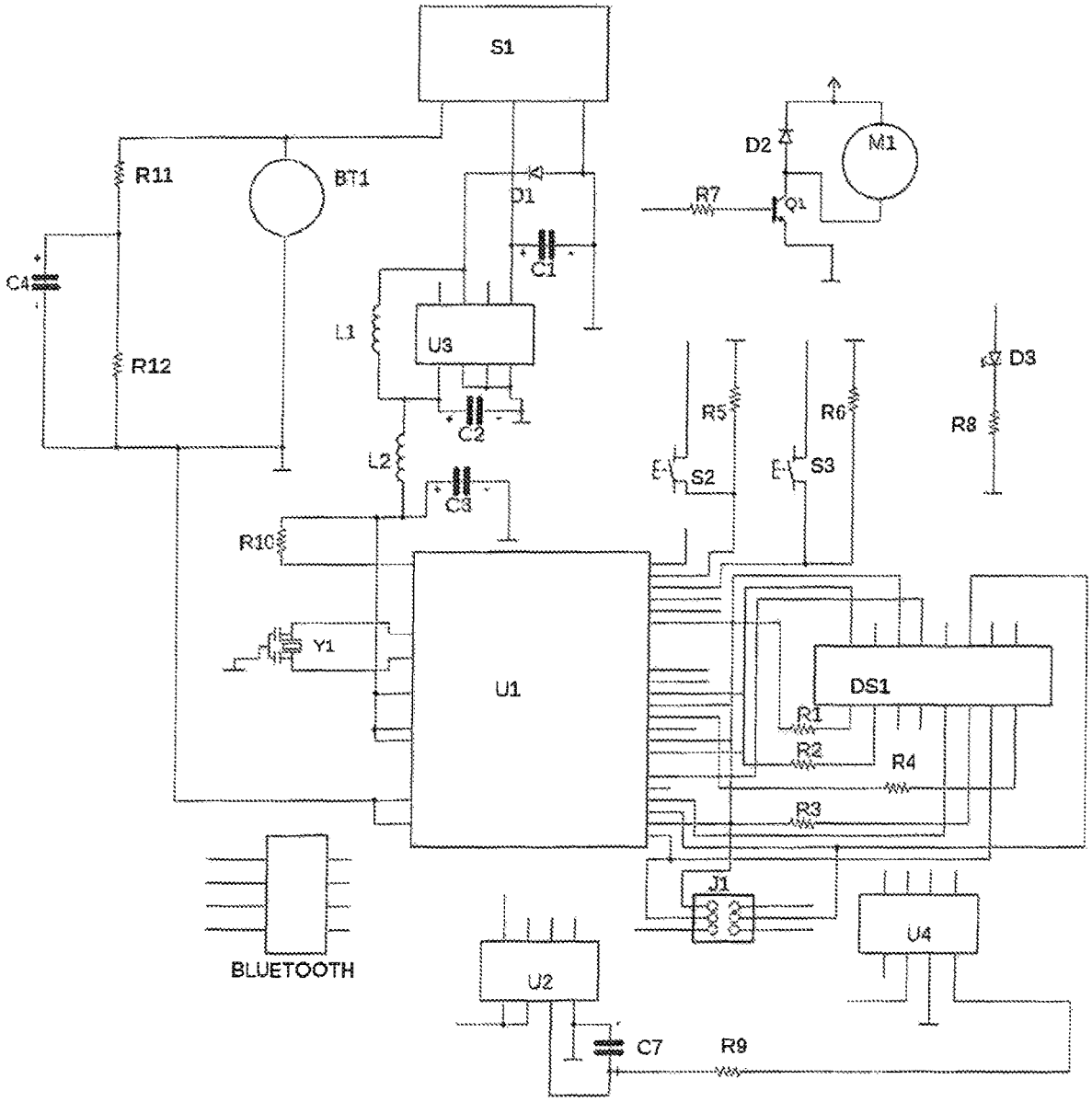
FIG. 6 is a schematic diagram of the system for pressurizing a beverage container according to the present disclosure.

FIG. 6 is a schematic diagram of the control and operational electronics for operating a system for pressurizing a beverage container according to one embodiment of the present disclosure. Although this example is included, system 10 can be implemented by other electronics to obtain similar operational results. Table 1 lists the components illustrated in FIG. 6.

TABLE 1

| | | |
|---|---|---|
| 43 | U1 | Controller |
| 48 | U2 | Op-Amp Filter |
| | U3 | 3.3 Step Down Regulator |
| 19 | U4 | Pressure Sensor |
| 13 | DS1 | LED Output Display |
| | Y1 | Oscillator |
| 14/15 | S2, S3 | Up/Down Switch |
| 11 | S1 | On/Off Switch |
| 41/42 | M1 | Gas Pump |
| 12 | D3 | Indicator LED |
| | Q1 | PWM Power Source |
| | C1 | Regulator Input Filtering |
| | C2, C3 | Regulator Output Filtering |
| | C4 | Sensor Power Filtering |
| | C5 | Sensor Power Filtering |
| | C6 | Sensor Output Filtering |
| | C7 | Signal Filtering |
| | D1, D2 | Flyback, Regulator Diode |
| | L1 | 1st Stage Inductor |

TABLE 1-continued

| | |
|---|---|
| L2 | 2nd Stage Inductor |
| R5, R6, R9 | Pull Up Resistors, Filtering |
| R1, R2, R3, R4, R7, R8 | Display, BJT, and LED Resistors |

Figure 7:
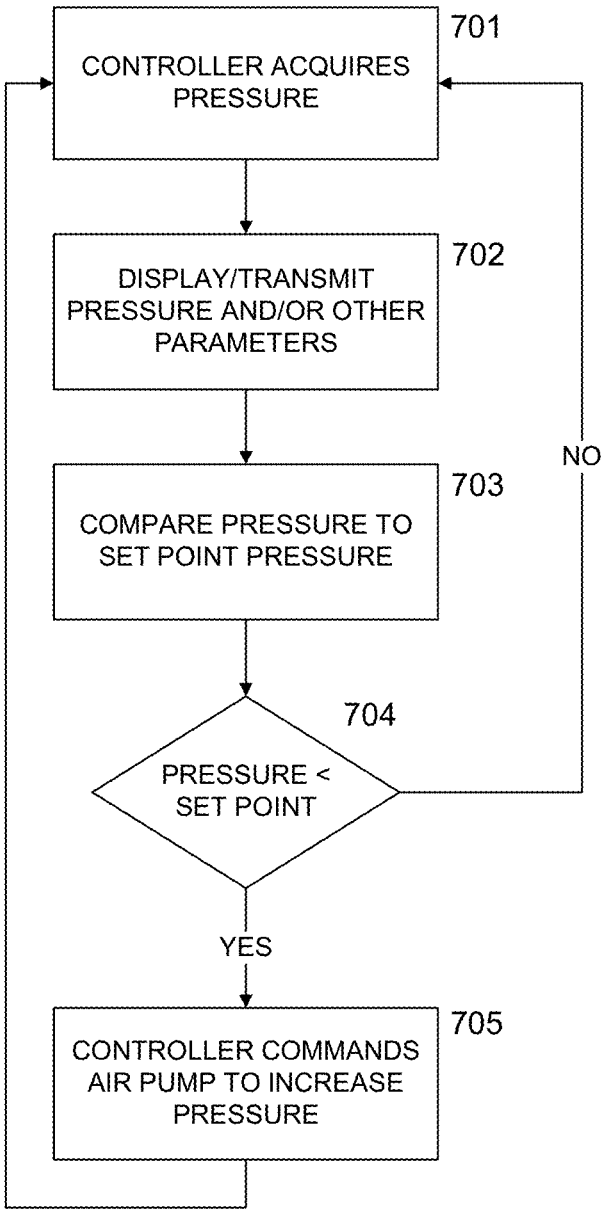
FIG. 7 is a flow diagram of a method for pressurizing a beverage container according to the present disclosure.

FIG. 7 is a flow chart illustrating a method for pressurizing a beverage container according to the present disclosure. It will be understood that each block of the flow chart can be implemented by computer program instructions.

In step 701, controller 43 periodically acquires the current sensed pressure of keg 30 obtained from electronic pressure sensor 19 of system 10. In step 702, controller 43 causes display 13 to display a current sensed keg pressure and/or other parameters and/or data. In step 703, controller 43 compares the current sensed pressure to the set point pressure. In decision step 704, controller 43 determines if the current sensed pressure is less than the set point pressure. If at decision step 704, controller 43 determines that the current sensed pressure is not less than the set point pressure, the process returns to step 701. If at decision step 704, controller 43 determines that the current sensed pressure is less than the set point pressure, controller 43 commands the motor/gas pump assembly 41/42 to turn on, and the process returns to step 701 to again sense the current sensed pressure.

Figure 8:
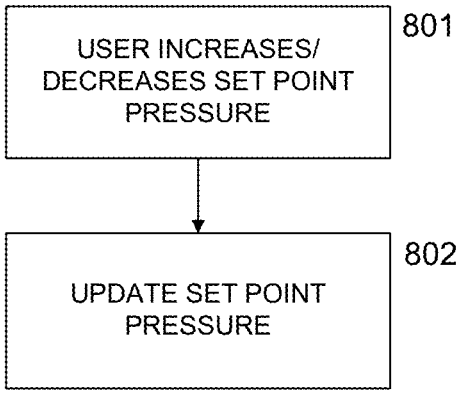
FIG. 8 is a flow diagram of a method for user input in a system for pressurizing a beverage container according to the present disclosure.

FIG. 8 is a flow diagram of a method for user input in a system for pressurizing a beverage container according to the present disclosure. In step 801 a user increases or decreases the set point pressure through input 14/15 of user interface or remote control 47. In step 802, controller 43 updates the set point pressure to that entered by the user.

In accordance with another feature of the invention, the system and method for pressurizing a beverage container can determine the volume of liquid inside the beverage container based on the ideal gas law. The ideal gas law is PV=nRT, where P is the pressure, V is volume, n is the mass and R is the ideal gas constant functionally related to Boltzmann's constant and Avogadro's constant, and T is the temperature above absolute zero (i.e., above 0 degrees Kelvin). Since T can be assumed constant and R is a constant, the volume of fluid for a particular beverage container can be approximated as: V=nRT/P. A measured change in the pressure for a known mass flow input is used to learn the value of V.

Figure 10:
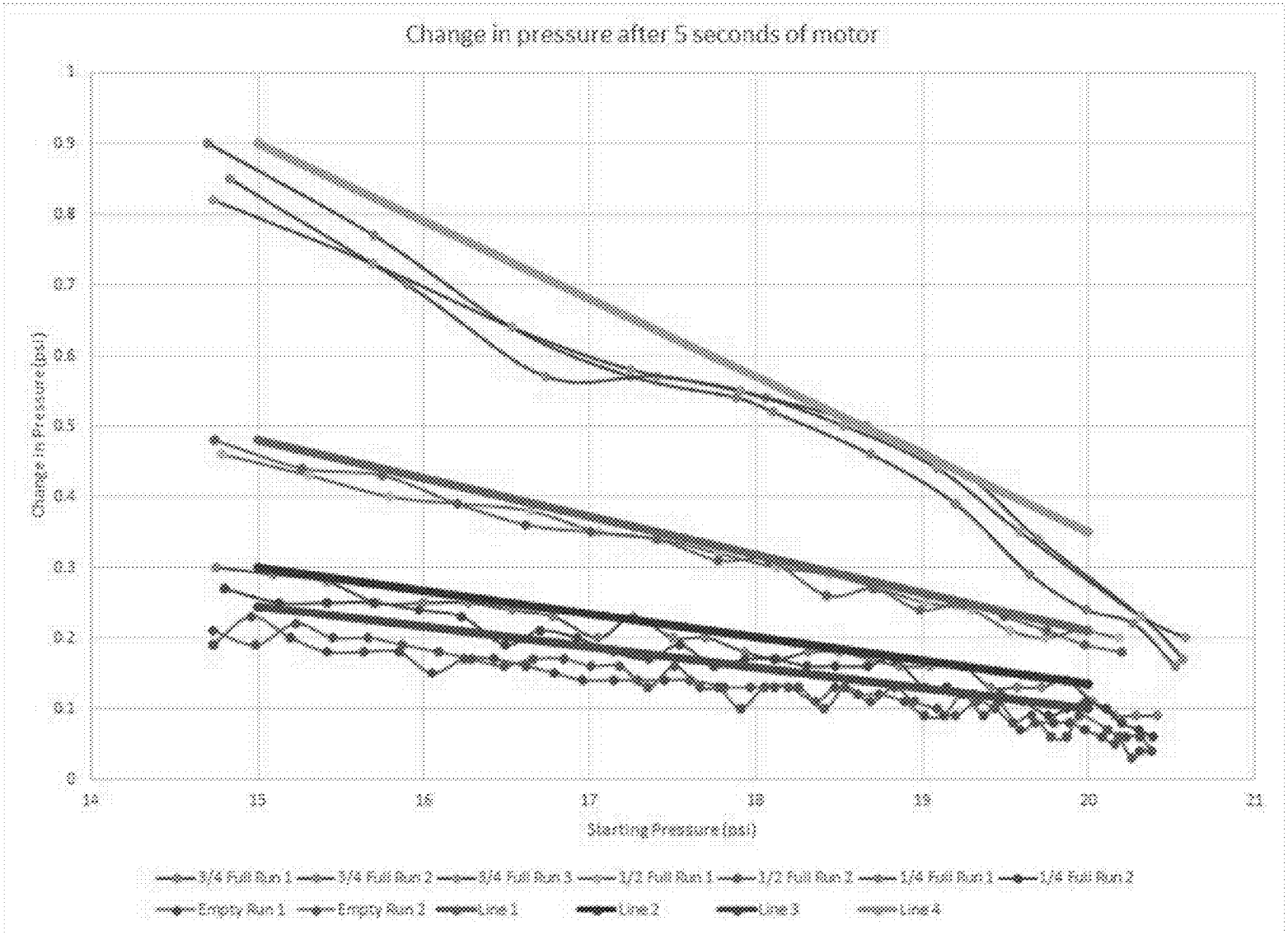
FIG. 10 is a graph of experimental results relating a change in pressure of a beverage container to a volume of liquid in the beverage container.

FIG. 10 shows a graph of experimental results derived from performing the afore-mentioned method steps, otherwise referred to herein as a calibration routine. As shown, the graph relates a change in pressure (psi) of the beverage container, e.g., keg 30, versus a starting pressure (psi) of the beverage container for different known volumes of fluid in the beverage container (e.g., empty, half-full, full) that have had the pump initiated at a constant power for a constant period of time. The bold lines are used to approximate the differences between the main sections. Before starting a calibration routine, a "starting pressure" is measured, and after the routine, the "change in pressure" is calculated. Resolving where this defined X-Y point is located relative to the known lines will result in a determination of the volume of the fluid remaining in the keg. This is done by using the equations of a given line (in the form y=mx+b) and inputting the measured starting pressure as "x" and obtaining a "y". If the actual change in pressure is more or less than this "y", this gives a relative value for the volume left in the keg. Additional comparisons to each known line will be used to determine the volume as accurately as possible.

The process can be performed by the following subroutine, where "start_pressure" is the measured starting pressure and "dp" is the measured change in pressure:

```
//Slope and y-intercept of Full line
float param_1_a = −0.11;
float param_1_b = 2.55;
//Slope and y-intercept of 3/4 line
float param_2_a = −0.054;
float param_2_b = 1.29;
//Slope and y-intercept of 1/2 line
float param_3_a = −0.033;
float param_3_b = 0.795;
//Slope and y-intercept of 1/4 line
float param_4_a = −0.029;
float param_4_b = 0.68;
if (dp > ((param_1_a * start_pressure) + param_1_b)){
    //beverage container is full
    }
else if (dp > ((param_2_a * start_pressure) + param_2_b)){
    // beverage container is 3/4 full
    }
else if (dp > ((param_3_a * start_pressure) + param_3_b)){
    // beverage container is 1/2 full
    }
else if (dp > ((param_4_a * start_pressure) + param_4_b)){
    // beverage container is 1/4 full
    }
else{
    // beverage container is empty
    }
```

Figure 9:
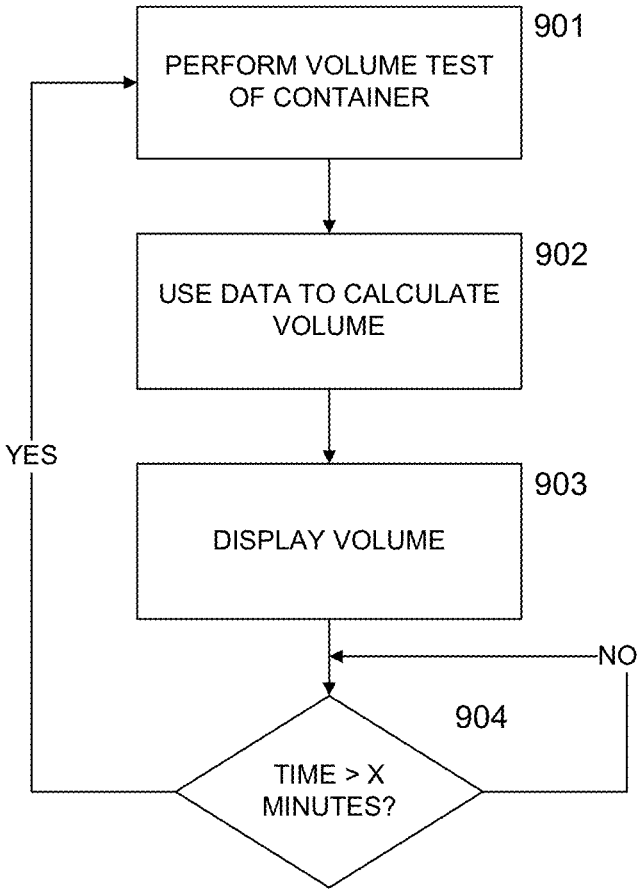
FIG. 9 is a flow diagram of a method for determining a volume of fluid in a beverage container according to the present disclosure.

FIG. 9 is a flow diagram of a method for determining a volume of fluid in a beverage container according to the present disclosure.

In step 901, controller 43 starts the volume test to determine the amount of liquid in the container. The volume test can be user initiated or preset to run on different triggering events, for example, a preset lapse of time (e.g. see step 904), or a change in pressure, etc. In step 902 both the measured starting pressure and calculated change in pressure are used to determine the volume. In step 903 the volume is displayed on display 13 and/or on remote control display (see FIG. 11). In step 904 a timer is activated and the test is again performed after a preset time period.

In another embodiment, identifying such a correlation may be performed in accordance with the following method steps, for a known volume of liquid in the beverage container:

(1) measuring the starting pressure in the beverage container at selected time sample $t_n$;

(2) initiating the motor/gas pump assembly 41/42 for a predetermined time, preferably 5 seconds; the predetermined time is contemplated to be substantially in the range of 5-60 seconds; it is possible that initiating the pump at a lower rate for a longer time will also give desired results.

(3) measuring the increase in pressure in the beverage container at the end of the predetermined time $t_{n+x}$;

(4) charting the relationship between the starting pressure versus the change in pressure for the known volume of liquid.

In an alternative embodiment, a lookup table includes a memory configured to store data relating the volume of beverage in the beverage container to the beverage container pressure. In accordance with such an embodiment, since volume is a function of pressure, temperature and mass flow rate according to the ideal Gas Law (PV=nRT), as discussed above, by adding known increments of gas (e.g., air, CO2) to a beverage container, such as keg 30, and for each of the known increments of liquid, a correlation between a change in pressure and the known volume of liquid may be deduced.

In some embodiments, the memory may store a lookup table or database linking the fluid volume to the container pressure. Based on the experimental results, a resulting lookup table may appear as follows:

| Starting Pressure | Change in Pressure | Volume |
|---|---|---|
| 15 | 1 | Full |
| 15 | 0.9 | Full |
| 15 | 0.8 | ¾ |
| 15 | 0.7 | ¾ |
| 15 | 0.6 | ¾ |
| 15 | 0.5 | ¾ |
| 15 | 0.4 | ½ |
| 15 | 0.3 | ¼ |
| 15 | 0.2 | Empty |
| 15 | 0.1 | Empty |
| 16 | 1 | Full |
| 16 | 0.9 | Full |
| 16 | 0.8 | Full |
| 16 | 0.7 | ¾ |

Clearly, such a look-up table may be produced with any level of precision desired and units may be liquid ounces, grams, pounds, etc. The look-up table, as defined herein, also refers in general to look-up means, and such a look-up means may alternately be a chart showing a graph relating the variables V and ΔP or a computational formula algorithm that is accessed via a digital computer, or other means for defining values of V corresponding to measured values of pressure.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

Where this application has listed the steps of a method or procedure in a specific order, it may be possible, or even expedient in certain circumstances, to change the order in which some steps are performed, and it is intended that the particular steps of the method or procedure claim set forth herein below not be construed as being order-specific unless such order specificity is expressly stated in the claim.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. A system for pressurizing a beverage container having a tapping connector, comprising:

a connector attachable to the tapping connector of the beverage container;

a gas pump operably connected to the connector for supplying pressurized gas into the beverage container through the tapping connector;

a pressure sensor operably connected to the beverage container for outputting a pressure signal corresponding to an internal pressure within the beverage container;

a power supply; and a controller adapted to:

acquire the internal pressure of the beverage container from the pressure sensor;

receive a set point pressure from a user;

compare the acquired internal pressure with the set point pressure; and control the gas pump to increase the internal pressure of the beverage container when the internal pressure is less than the set point pressure and which controller controls the gas pump using a proportional integral derivative-based control scheme or a pulse with modulation-based control scheme in a manner that a flow rate for the gas pump slows down as the set point pressure is approached.

2. The system of claim 1, wherein the controller is adapted to control the gas pump to be turned off when the internal pressure is equal to or more than the set point pressure.

3. The system of claim 2, wherein the controller is adapted to repeat actions including:

the acquiring of the internal pressure of the beverage container from the pressure sensor;

the comparing of the acquired internal pressure with the set point pressure;

the controlling of the gas pump to increase the internal pressure of the beverage container when the internal pressure is less than the set point pressure; and the controlling of the gas pump to be turned off when the internal pressure is equal to or more than the set point pressure.

4. The system of claim 1, further comprising:

a memory operatively coupled to the controller, the memory retaining program codes to operate the system for pressurizing the beverage container.

5. The system claim 4, wherein the memory further retains a lookup table or a database to correlate the internal pressure and a change in pressure to a fluid volume in the beverage container.

6. The system of claim 1, wherein the beverage container s a beer keg.

7. An apparatus for pressuring a beverage container, said apparatus comprising:

a housing defining an interior volume, a controller disposed in said housing, a pressure sensor operably connected to the beverage container and configured to sense the internal pressure within the beverage container, said pressure sensor further configured to output to the controller a pressure signal representative of the sensed pressure;

a connector attachable at a first end to a tapping connector of the beverage container and at a second end to the pressure sensor for sensing a pressure within the beverage container, a gas pump connected to the connector and configured to supply pressurized gas into the beverage container through the tapping connector to create pressure therein;

a display configured to display the internal pressure within the beverage container based on the pressure signal output by the pressure sensor;

a user interface supported by a surface of said housing to enable a user to change a set point pressure within the beverage container during regular use, wherein the controller is configured to:

acquire the internal pressure of the beverage container sensed and output by said pressure sensor;

receive the set point pressure from the user interface;

compare the acquired internal pressure with the set point pressure; and control the gas pump to increase the internal pressure of the beverage container when the internal pressure is less than the set point pressure and which controller controls the gas pump using a proportional integral derivative-based control scheme or a pulse width modulation-based control scheme in a manner that a flow rate for the gas pump slows down as the set point pressure is approached; and a power supply for supplying power to said pressure sensor, said controller, said display unit and said user interface.

8. The apparatus of claim 7, wherein the controller is adapted to control the gas pump to be turned off when the internal pressure is equal to or more than the set point pressure.

9. The apparatus of claim 8, wherein the controller is adapted to repeat actions including:

the acquiring of the internal pressure of the beverage container from the pressure sensor;

the comparing of the acquired internal pressure with the set point pressure;

the controlling of the gas pump to increase the internal pressure of the beverage container when the internal pressure is less than the set point pressure; and the controlling of the gas pump to be turned off when the internal pressure is equal to or more than the set point pressure.

10. The apparatus of claim 7, further comprising:

a memory operatively coupled to the controller, the memory retaining program codes to operate the system for pressurizing the beverage container.

11. The apparatus of claim 10, wherein the memory further retains a lookup table or a database to correlate the internal pressure and a change in pressure to a fluid volume in the beverage container.

12. The apparatus of claim 7, further comprising:

a display for displaying the internal pressure within the beverage container and/or a user selected set point pressure.

13. The apparatus of claim 7, further comprising:

a transceiver for transmitting and/or receiving wireless signals; and a remote control device wirelessly connected to the transceiver for transmitting and/or receiving the wireless signals.

14. A method for regulating the pressure within a beverage container during regular use, comprising:

acquiring, by a controller, an internal pressure of the beverage container from a pressure sensor;

receiving, by the controller, a set point pressure from a user comparing, by the controller, the acquired internal pressure with the set point pressure; and controlling, by the controller, a gas pump to increase the internal pressure of the beverage container when the internal pressure is less than the set point pressure and which controller controls the gas pump using a proportional integral derivative-based control scheme or a pulse width modulation-based control scheme in a manner that a flow rate for the gas pump slows down as the set point pressure is approached.

15. The method of claim 14, wherein the gas pump supplies pressurized gas into the beverage container through a tapping connector.

16. The method of claim 14, further comprising:

controlling, by the controller, the gas pump to be turned off when the internal pressure is equal to or more than the set point pressure.

17. The method of claim 16, further comprising:

repeating, by the controller, actions including:

the acquiring of the internal pressure of the beverage container from the pressure sensor;

the comparing of the acquired internal pressure with the set point pressure;

the controlling of the gas pump to increase the internal pressure of the beverage container when the internal pressure is less than the set point pressure; and the controlling of the gas pump to be turned off when the internal pressure is equal to or more than the set point pressure.

18. The system of claim 1, wherein the controller controls the gas pump using a proportional integral derivative-based control scheme in a manner that a flow rate for the gas pump slows down as the set point pressure is approached.

19. The apparatus of claim 7 wherein the controller controls the gas pump using a proportional integral derivative-based control scheme in a manner that a flow rate for the gas pump slows down as the set point pressure is approached.

20. The method of claim 14 wherein the controller controls the gas pump using a proportional integral derivative-based control scheme in a manner that a flow rate for the gas pump slows down as the set point pressure is approached.

* * * * *